United States Patent [19]

Seidel

[11] Patent Number: 4,906,166

[45] Date of Patent: Mar. 6, 1990

[54] LIQUID COOLANT CIRCULATING SYSTEM EMPLOYING INTERGRATED PUMP/ACCUMULATOR

[75] Inventor: William E. Seidel, Rockford, Ill.

[73] Assignee: Sundstrand Corporation, Rockford, Ill.

[21] Appl. No.: 116,681

[22] Filed: Nov. 4, 1987

[51] Int. Cl.[4] ..... F04B 17/00

[52] U.S. Cl. ..... 417/414

[58] Field of Search ..... 417/414, 421, 410; 138/31

[56] References Cited

U.S. PATENT DOCUMENTS

| | | | |
|---|---|---|---|
| 862,867 | 8/1907 | Eggleston | 417/390 |
| 1,649,356 | 11/1927 | Louis | 417/471 |
| 2,002,907 | 5/1935 | Sessions | 417/414 |
| 2,404,283 | 7/1946 | Blom | 417/414 |
| 2,423,436 | 7/1947 | Blom | 417/414 |
| 2,545,422 | 3/1951 | Blom | 417/414 |
| 2,554,191 | 5/1951 | Hubor | 417/414 |
| 2,682,229 | 6/1954 | Luenberger | 417/414 |
| 2,833,219 | 5/1958 | Lewis . | |
| 2,934,025 | 4/1960 | Wilson | 138/31 |
| 3,075,469 | 1/1963 | Lane, Jr. | 417/414 |
| 3,187,991 | 6/1965 | Roelsgaard . | |
| 3,434,656 | 3/1969 | Bellmer . | |
| 3,724,972 | 4/1973 | Guetersloh | 417/307 |
| 3,862,646 | 1/1975 | Tarsha | 138/31 |
| 4,147,479 | 4/1979 | Morse . | |
| 4,538,972 | 9/1985 | Gooden . | |
| 4,545,743 | 10/1985 | Earley . | |
| 4,564,339 | 1/1986 | Nakamura et al. . | |
| 4,571,159 | 2/1986 | Beardmore | 417/540 |
| 4,592,703 | 6/1986 | Imaba et al. . | |

FOREIGN PATENT DOCUMENTS

| | | | |
|---|---|---|---|
| 688609 | 6/1964 | Canada | 417/540 |
| 1138975 | 6/1957 | France | 417/414 |
| 57-16281 | 4/1982 | Japan . | |
| 57-165681 | 10/1982 | Japan . | |
| 28771 | 2/1986 | Japan | 417/540 |

*Primary Examiner*—Leonard E. Smith

*Attorney, Agent, or Firm*—Wood, Dalton, Phillips, Mason & Rowe

[57] ABSTRACT

An integrated pump and accumulator assembly for use in a system circulating a liquid coolant or the like. A housing defines a pump chamber and an integral closed accumulator chamber. A pump is disposed in the pump chamber and includes a coolant circulating inlet and an outlet. A hermetically sealed expandable and contractable reservoir is disposed in the accumulator chamber. A liquid conduit communicates between the pump chamber and the accumulator chamber on one side of the expandable and contractable reservoir whereby expansion and contraction of the coolant is accommodated by the reservoir. The accumulator chamber is charged with a gas on an opposite side of the reservoir.

7 Claims, 1 Drawing Sheet

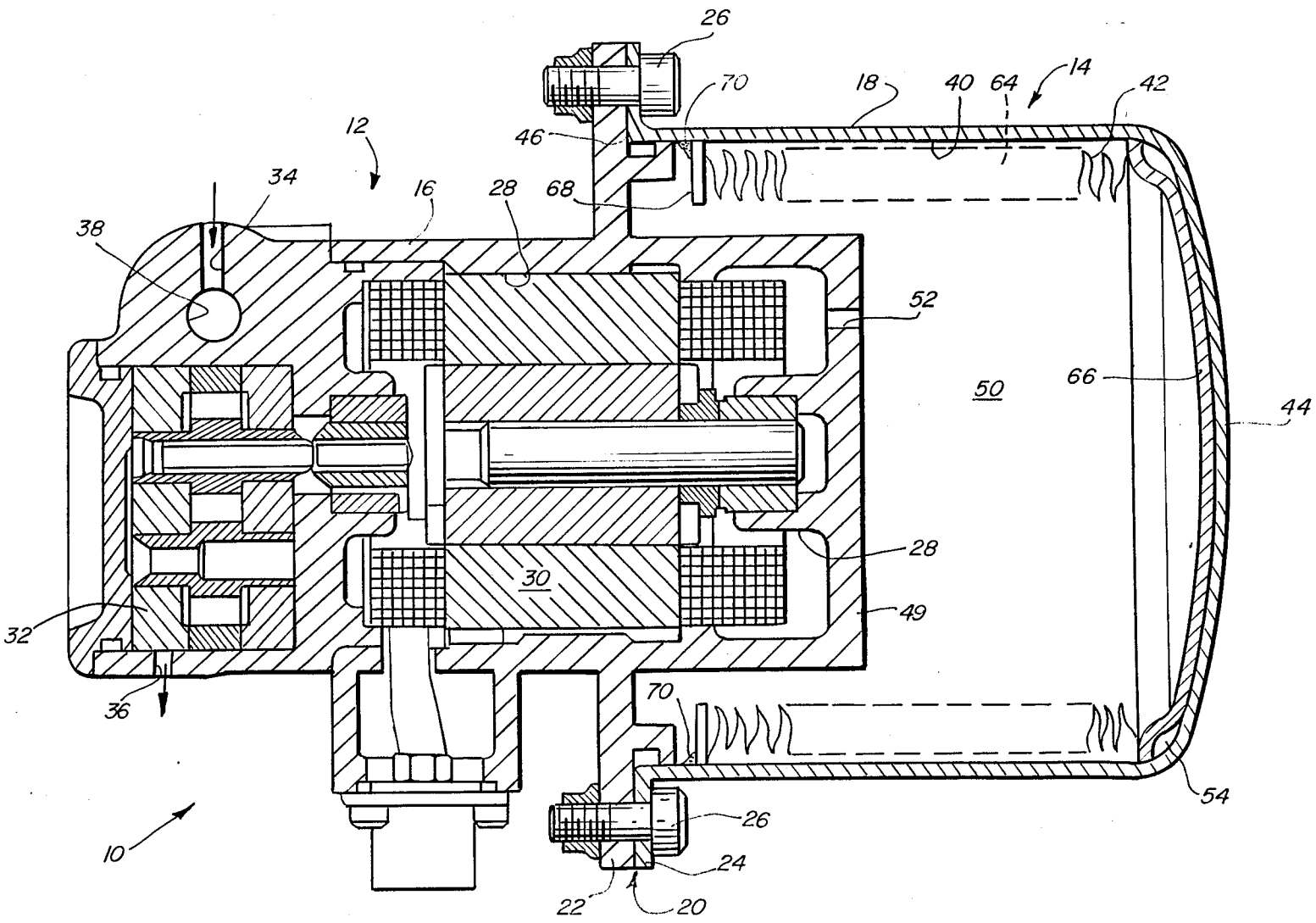
44
54
42
66
14
64
50
40
52
28
49
18
26
70
26
24
20
70
68
22
46
28
30
16
12
34
38
36
10
32

LIQUID COOLANT CIRCULATING SYSTEM EMPLOYING INTERGRATED PUMP/ACCUMULATOR

FIELD OF THE INVENTION

This invention generally relates to systems for circulating liquid coolant or the like under pump pressure and, particularly, to such a system which employs an accumulator integral with the pump to accommodate expansion and contraction of the coolant.

BACKGROUND OF THE INVENTION

A variety of systems employ pump means for circulating a liquid to cool various components of the system such as the electronics. The pump draws the liquid through an inlet at low pressure and discharges the liquid at a higher pressure throughout the system. Often, the system includes accumulator or reservoir means to accommodate expansion and contraction of the coolant as might occur because of temperature variances. For instance, when the coolant heats up, the coolant expands into the accumulator and is returned should the coolant drop in temperature.

Conventionally, the accumulator is a separate component of the system from the pump means. It often can even be remote from the pump means and connected in the system by appropriate conduit means.

Sometimes, a "boot strap" accumulator is used such as that shown in Gooden U.S. Pat. No. 4,538,972, dated Sept. 3, 1987. Such boot strap accumulators or reservoirs, as shown in Gooden, include a movable or expandable piston or other reservoir means which actually forms part of the circulation system. In other words, liquid is circulated to both sides of the reservoir device.

The present invention is directed to a new and improved system in which the accumulator actually is formed as an integral part of the circulating pump means. Circulation is not directed to both sides of the reservoir device of the accumulator, but, instead, the accumulator is gascharged and mounted integral with the pump casing with liquid communication directly from the pump into the interior expandable and contractable reservoir device of the accumulator.

SUMMARY OF THE INVENTION

An object, therefore, of the invention is to provide a system circulating a liquid coolant or the like under pump pressure and including a new and improved integrated pump and accumulator.

More particularly, in the exemplary embodiment of the invention, housing means are provided defining a pump chamber and an integral closed accumulator chamber. Pump means are disposed in the pump chamber and includes coolant circulating inlet and outlet means. Hermetically sealed expandable and contractable reservoir means are disposed in the accumulator chamber. Liquid conduit means communicate between the pump chamber and the accumulator chamber on one side of the expandable and contractable reservoir means, whereby expansion and contraction of the coolant is accommodated by the reservoir means. The accumulator chamber is charged with a gas on an opposite side of the reservoir means.

Specifically, the housing means may include a casing portion defining the pump chamber for housing the pump means, and an accumulator portion projecting from one end of the casing portion defining the closed accumulator chamber for enclosing the reservoir means. The projecting accumulator portion may be generally cylindrical with a closed end remote from the casing portion and an open end joined to the casing portion. The reservoir means may comprise a bellows of complementary configuration nested within the accumulator portion, with a closed end remote from the casing portion and an open end communicating with the liquid conduit means.

With such an integral structure, the casing portion and the accumulator portion of the housing can include complementarily engageable outwardly projecting flanges for mounting the housing portions together as well as mounting the integral unit to a supporting structure of the system.

Other objects, features and advantages of the invention will be apparent from the following detailed description taken in connection with the accompanying drawings.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawing, in which like reference numerals identify like elements in the FIGURE and in which the singular FIGURE is a generally axial section through the integrated pump/accumulator of the invention.

DETAILED DESCRIPTION OF THE PREFERRED EMBODIMENT

Referring to the drawing in greater detail, the invention is embodied in a system for circulating a liquid coolant or the like under pump pressure. The invention contemplates an integrated pump and accumulator assembly, generally designated 10, and generally including a pump means 12 and an accumulator means 14.

The assembly 10 incorporates an integrated housing means having a casing portion 16 and an accumulator portion 18 projecting from one end of casing portion 12. The casing and accumulator portions of the housing are joined by outwardly projecting flange means, generally designated 20. Specifically, casing portion 16 has a radially outwardly projecting flange 22 and accumulator portion 18 has a complementarily engageable flange 24. Flanges 22 and 24 are joined by appropriate fastener means 26 to define the integrated housing means.

Casing portion 16 of the integrated housing means defines a pump chamber 28 for housing the pump means. The pump means is generally conventional and includes a rotorstator assembly 30 and a pump vane assembly 32 for drawing coolant in through inlet means 34 under relatively low pressure and discharging the coolant through outlet means 26 under an increased or higher pressure. The coolant thereby is circulated through a given system to cool various components thereof such as the electronic components. As is conventional, inlet 34 and outlet 36 are in communication with appropriate circumferential passageways 38 so that the coolant is admitted to one side of the pump vanes and discharged from the other side thereof.

Accumulator portion 18 of the integrated housing defines a closed accumulator chamber 40 for enclosing reservoir means in the form of a bellows construction 42. Accumulator housing portion 18 may be generally cylindrically shaped with a closed end 44 remote from pump means 12 and an open end 46 surrounding an inner end 49 of casing portion 16 of the integrated housing. The bellows-type reservoir 42 also may be generally cylindrically shaped and include a cylindrical bellows portion 64, a closed end 66 and an open end 68. The reservoir means 42 defined by the bellows construction is hermetically sealed and is itself sealed, as at 70, to the interior walls of accumulator portion 18 of the housing. This construction thereby defines a reservoir chamber 50 within reservoir means 42.

Liquid conduit means in the form of an opening 52 communicates between reservoir 50 inside of reservoir means 42 and pump chamber 28 within housing casing portion 16. Thereby, expansion and contraction of coolant passing through the pump means is accommodated by the reservoir means which itself is expandable and contractable. In other words, should the coolant be heated because of temperature variances within the system, the coolant will expand and the expandable reservoir means will accommodate this expansion.

As stated above, reservoir means 42 is hermetically sealed and also sealed at 70 to the interior of accumulator housing portion 18. This defines a space 54 between accumulator housing portion 18 and the reservoir means. This space is charged with a gas at a sufficiently high pressure so that the pump inlet and conduit 52 are always charged (i.e. avoiding the pump operating under vacuum conditions). The degree or pressure to which space 54 is charged simply is calculated by the total volume of coolant in the system and the temperature range anticipated such that the precharged gas can accommodate the given range of temperature variances. As an example, a pump as shown and described may operate at 84 psi at inlet 34 and 155 psi at outlet 36. In order to accommodate a temperature variance range of −85° F. to 225° F., a gaseous volume of 8.0 cubic inches would be appropriate.

By employing an integrated housing, separate accumulators of conventional systems are obviated. Mating flanges 22 and 24 of integrated housing portions 16 and 18 also can be employed to mount the unitary device 10 to a supporting structure in the system, as by fastening means 26. The specific configurations of housing accumulator portion 18 and reservoir means 42, of course, may be other than cylindrical in shape.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed:

1. In a system circulating a liquid coolant or the like under pump pressure, an integrated pump and accumulator, comprising:

housing means including a casing portion defining a pump chamber and an elongated accumulator portion coupled to and projecting from one end of the casing portion defining an integral closed accumulator chamber;

outwardly projecting flange means coupling said casing portion and said accumulator portion of the housing means;

pump means disposed in said pump chamber and including coolant circulating inlet and outlet means;

hermetically sealed expandable and contractable reservoir means shaped complementary to the elongated accumulator portion of the housing and nested within the interior of said accumulator chamber;

liquid conduit means communicating between the pump chamber and the accumulator chamber on one side of the expandable and contractable reservoir means whereby expansion and contraction of the coolant is accommodated by the reservoir means; and said accumulator chamber being charged with a gas on an opposite side of the reservoir means.

2. In a system as set forth in claim 1 wherein said flange means comprise complementarily engageable outwardly projecting flanges on the casing portion and the accumulator portion which are coupled together by fastener means.

3. In a system circulating a liquid coolant or the like under pump pressure, an integrated pump and accumulator, comprising:

housing means including a casing portion defining a pump chamber and a separate elongated accumulator portion coupled to and projecting from one end of the casing portion defining an integral closed accumulator chamber, the accumulator portion having a closed end remote from the casing portion and an open end coupled to the casing portion, said casing portion and accumulator portion being coupled by outwardly projecting flange means;

pump means disposed in said pump chamber within the casing portion of the housing and including coolant circulating inlet and outlet means;

hermetically sealed expandable and contractable reservoir means shaped complementary to the elongated accumulator portion of the housing and nested within the interior of said accumulator chamber, the reservoir means having a closed end remote from the casing portion of the housing and an open end adjacent said one end of the casing portion; and liquid conduit means communicating between the pump chamber and the accumulator chamber on one side of the expandable and contractable reservoir means, through the open end of the reservoir means, whereby expansion and contraction of the coolant is accommodated by the reservoir means.

4. In a system as set forth in claim 3 wherein said accumulator chamber is charged with a gas on an opposite side of the reservoir means.

5. In a system as set forth in claim 3 wherein said flange means comprise complementarily engageable outwardly projecting flanges on the casing portion and the accumulator portion which are coupled together by fastener means.

6. In a system as set forth in claim 3 wherein said reservoir means comprise a bellows means sealed to the interior of the accumulator portion.

7. In a system as set forth in claim 6 wherein said bellows means has an open end facing the pump chamber and said liquid conduit means.

* * * * *